US008413848B2

(12) United States Patent
McGuffey

(10) Patent No.: US 8,413,848 B2
(45) Date of Patent: Apr. 9, 2013

(54) HOT MELT ADHESIVE METERING SYSTEM WITH INTERCHANGEABLE OUTPUT ASSEMBLIES

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 705 days.

(21) Appl. No.: 12/385,046

(22) Filed: Mar. 30, 2009

(65) Prior Publication Data

US 2009/0266844 A1 Oct. 29, 2009

Related U.S. Application Data

(60) Provisional application No. 61/071,384, filed on Apr. 25, 2008.

(51) Int. Cl.
*B67D 7/80* (2010.01)

(52) U.S. Cl.
USPC ..... 222/146.5; 239/548; 222/504

(58) Field of Classification Search ..... 222/146, 222/5, 146.6, 504, 318, 333, 146.5, 146.1, 222/146.2; 239/266–268, 548; 118/320, 118/411
See application file for complete search history.

(56) References Cited

U.S. PATENT DOCUMENTS

| | | | | |
|---|---|---|---|---|
| 6,089,413 | A * | 7/2000 | Riney et al. | 222/318 |
| 6,168,049 | B1 | 1/2001 | Bolyard, Jr. | |
| 6,171,089 | B1 | 1/2001 | Oehman, Jr. | |
| 6,422,428 | B1 | 7/2002 | Allen et al. | |
| 6,499,631 | B2 * | 12/2002 | Zook | 222/146.6 |
| 6,688,498 | B1 | 2/2004 | McGuffey | |
| 6,814,310 | B2 * | 11/2004 | Boger | 239/548 |
| 7,908,997 | B2 * | 3/2011 | Lessley et al. | 118/411 |
| 2004/0099752 | A1 | 5/2004 | Boger | |
| 2008/0023489 | A1 * | 1/2008 | Lessley | 222/146.5 |

* cited by examiner

*Primary Examiner* — Lien Ngo
(74) *Attorney, Agent, or Firm* — Law Offices of Steven W. Weinrieb

(57) ABSTRACT

A hot melt adhesive or other thermoplastic material metering system has different output assemblies interchangeably mounted thereon in a modular manner. In this manner, if it is desired to effectively convert a particular metering system from one type of metering system to another type of metering system, a particular output assembly can be exchanged for a different output assembly. In addition, if a particular output assembly needs to be replaced or repaired, the particular output assembly can be simply removed and a new similar output assembly can be simply installed.

11 Claims, 8 Drawing Sheets

HOT MELT ADHESIVE METERING SYSTEM WITH INTERCHANGEABLE OUTPUT ASSEMBLIES

CROSS REFERENCE TO RELATED PATENT APPLICATIONS

This patent application is related to, and based upon, U.S. Provisional Patent Application Ser. No. 61/071,384 which was filed on Apr. 25, 2008, the priority benefits of which are hereby claimed.

FIELD OF THE INVENTION

The present invention relates generally to hot melt adhesive or other thermoplastic material dispensing systems, and more particularly to a new and improved hot melt adhesive or other thermoplastic material metering system which is capable of having different output assemblies interchangeably mounted thereon, such as, for example, a metered output assembly having output hose connections mounted thereon so as to effectively form a metering station for conducting metered amounts of the hot melt adhesive or other thermoplastic material to downstream applicator heads, an output assembly which is capable of spraying hot melt adhesive or other thermoplastic materials onto a substrate in accordance with non-contact methods or techniques, or an output assembly for depositing a thin film coating of the hot melt adhesive or other thermoplastic material onto a moving substrate as a result of being disposed in direct contact with the substrate. In this manner, if it is desired to effectively convert a particular metering system from one type of metering system to another type of metering system, a particular output assembly can be exchanged for a different output assembly. In addition, if a particular output assembly needs to be replaced or repaired, the particular output assembly can be simply removed and a new similar output assembly can be simply installed.

BACKGROUND OF THE INVENTION

In connection with hot melt adhesive or other thermoplastic material metering systems, it is often necessary to meter predetermined amounts or volumes of the materials by means of, for example, one or more metering pumps, such that the metered amounts of the materials can be used for specific purposes. In turn, in order to in fact use the metered volumes or amounts of the materials for the respective specific purposes, various different output assemblies or devices are required. One such output device or assembly may comprise, for example, a metered output assembly or device that has a plurality of output hose connections mounted thereon so as to effectively form a metering station for conducting metered amounts of the hot melt adhesive or other thermoplastic material to a plurality of downstream applicator heads. Another example of an output assembly or device may be a spray type output assembly or device which is operatively associated with a source of process air which effectively entrains or carries the hot melt adhesive or other thermoplastic material and sprays the same onto a moving substrate in accordance with non-contact techniques or methods. Still further, another example of an output assembly or device may be a film coating assembly or device wherein a die assembly has a longitudinal slot formed therewithin so as to effectively distribute a film of the hot melt adhesive or other thermoplastic material onto the moving substrate as a result of being disposed in contact with the substrate.

Conventionally, each overall metering system is fabricated or manufactured with the end use objective being determinative of the actual structure comprising each metering system. Accordingly, if it was desired to effectively convert, for example, one of the aforenoted particular types of metering systems to a different type of metering system, it would be virtually impossible to do so without substantially disassembling the original metering system and re-assembling or rebuilding a substantially different metering system. In addition, such a disassembling and re-assembling or rebuilding process would be prohibitively expensive and time consuming. Similar difficulties may likewise be encountered if operational problems develop within one of the aforenoted metering systems. More particularly, if an operational problem develops within a conventional metering system which requires the metering system to be shut down so as to permit maintenance personnel to implement the required maintenance or repair procedures, valuable production time is lost.

A need therefore exists in the art for a new and improved metering system wherein, in lieu of all, or a significant number, of the operative components of the overall metering system being integrally formed together as a single piece entity, or as a limited or small number of single piece entities, the operative components of the overall metering system would comprise modular components which can be readily, easily, and quickly assembled together, disassembled from each other, and reassembled to each other, so as to form entirely different types of metering systems, or alternatively, to readily, easily, and quickly facilitate the replacement of a failed component within a particular existing and previously operational metering system.

SUMMARY OF THE INVENTION

The foregoing and other objectives are achieved in accordance with the teachings and principles of the present invention through the provision of a new and improved hot melt adhesive or other thermoplastic material metering system which comprises multiple different modular components, assemblies, or devices. For example, each metering system will comprise a motor drive assembly, a drive gear manifold assembly which has a plurality of metering pumps disposed thereon, and an interface block which receives an incoming supply of the hot melt adhesive or other thermoplastic material. The interface block is fluidically connected to the drive gear manifold assembly such that the hot melt adhesive or other thermoplastic material can be supplied to the plurality of metering pumps, and, in turn, the plurality of metering pumps can output metered amounts of the hot melt adhesive or other thermoplastic material back to the interface block such that the metered amounts of the hot melt adhesive or other thermoplastic material can be outputted to any one of several different output assemblies or devices which are adapted to be individually mounted in an interchangeable or exchangeable modular manner upon the interface block. In this manner, if it is desired to effectively convert a particular metering system, characterized by means of a first type of output assembly or device, to another type of metering system, characterized by means of a second type of output assembly or device, the first output assembly or device can be readily, easily, and quickly removed from the interface block, and the second output assembly or device can be readily, easily, and quickly installed upon the interface block. In addition, if a particular type of output assembly or devices needs to be replaced or repaired, the particular output assembly or device can be readily, easily, and quickly removed from the interface block and a new similar output assembly or device can be readily, easily, and quickly installed upon the interface block.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
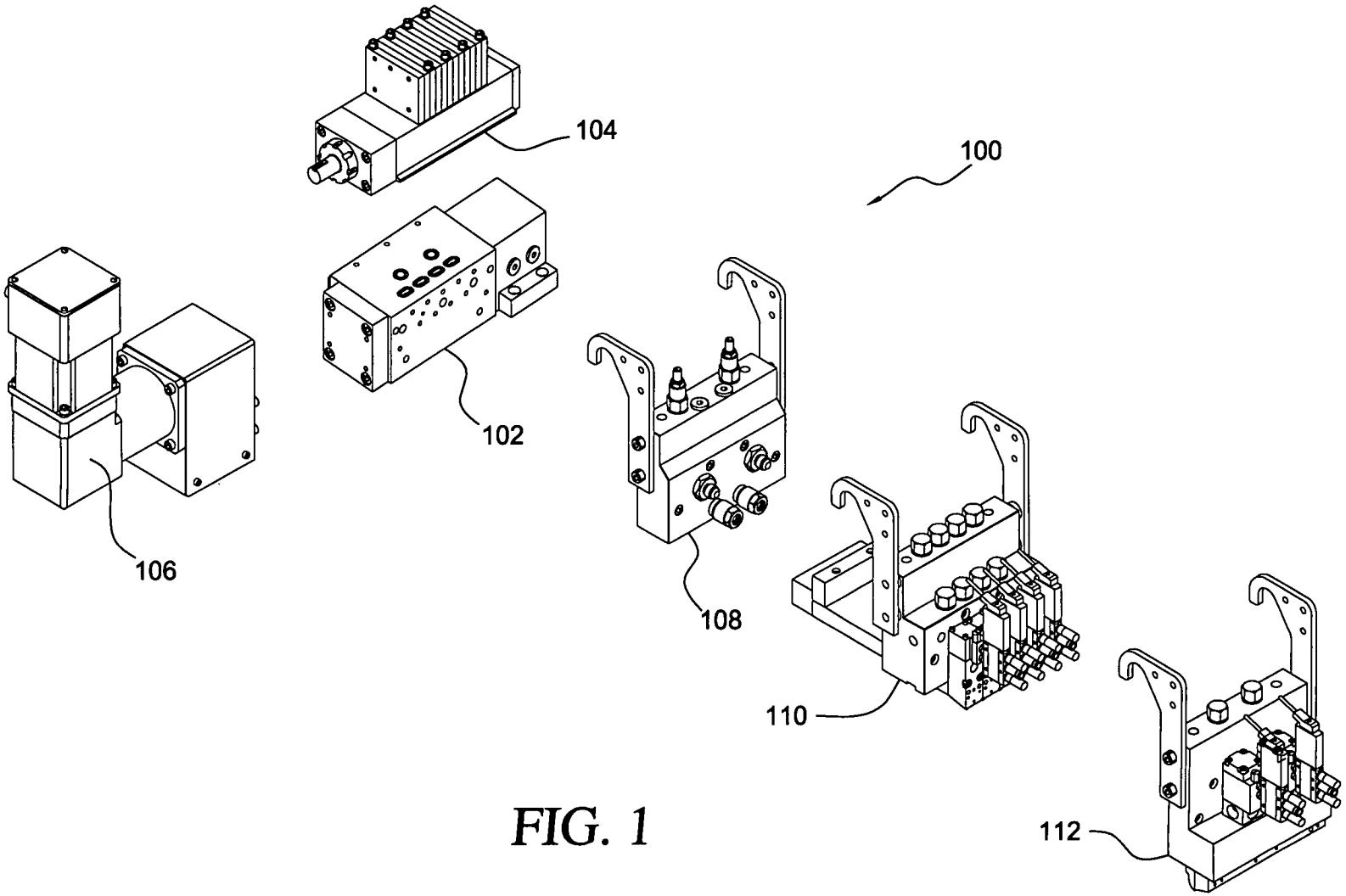
FIG. 1 is an exploded perspective view of a new and improved modular hot melt adhesive or other thermoplastic material metering system which has been constructed in accordance with the principles and teachings of the present invention and which comprises a plurality of basic components, such as, for example, an interface block assembly, a drive gear manifold assembly, and a motor drive assembly, together with a plurality of different types of output assemblies or devices which, as a result of being individually selected for mounting upon the interface block assembly of the hot melt adhesive or other thermoplastic metering system, can configure or construct a particular type of hot melt adhesive or other thermoplastic material metering system.

Referring now to the drawings, and more particularly to FIG. 1 thereof, a new and improved hot melt adhesive or other thermoplastic metering system, which has been constructed in accordance with the principles and teachings of the present invention and which shows the cooperative parts thereof, is disclosed and is generally indicated by the reference character 100. As will become more apparent hereinafter, the new and improved hot melt adhesive or other thermoplastic metering system 100 comprises a plurality of basic components, together with a plurality of different types of output assemblies or devices which, as a result of being individually selected for interchangeable mounting upon a particular one of the plurality of basic components of the hot melt adhesive or other thermoplastic metering system in a modular manner, can effectively result in the configuration or construction of a particular type of hot melt adhesive or other thermoplastic material metering system to be used for a specific type of hot melt adhesive or other thermoplastic material dispensing or deposition. More particularly, for example, it is seen that the new and improved hot melt adhesive or other thermoplastic material metering system 100 comprises an interface block assembly 102 which, for example, among other functions, is adapted to receive a supply of the hot melt adhesive or other thermoplastic material to be pumped and discharged.

A drive gear manifold assembly 104 is adapted to be fixedly but removably mounted atop the interface block assembly 102, and a motor drive assembly 106, in addition to also being fixedly but removably mounted upon the interface block assembly 102, is adapted to be operatively connected to the drive gear manifold assembly 104. It is to be appreciated that the interface block assembly 102, and the various components thereof, the drive gear manifold assembly 104, and the various components thereof, and the motor drive assembly 106, and the various components thereof, comprise the basic assemblies necessary for the formulation or construction of the overall metering system 100. In other words, as a result of being assembled together so as to operatively work together, in a manner that will become more apparent hereinafter, hot melt adhesive or other thermoplastic material is effectively conducted into the metering system 100, and more particularly into the interface block assembly 102 of the metering system 100, and predetermined metered amounts of the hot melt adhesive or other thermoplastic material are effectively dispensed outwardly from the metering system 100, again, more particularly, out from the interface block assembly 102 of the metering system 100. The metered amounts of the hot melt adhesive or other thermoplastic material, outputted from, for example, the interface block assembly 102 of the metering system 100, can then be conducted to any one of several different output assemblies, each one of which can perform a different hot melt adhesive or other thermoplastic material dispensing function or operation, whereby when a particular one of the several different output assemblies is in fact mounted upon the interface block assembly, a particular type of metering system 100 will effectively be formed or constructed.

For example, as is also illustrated within FIG. 1, one such output assembly may comprise a metered output assembly 108 which has a plurality of output hose connections mounted thereon so as to effectively form a metering station for conducting metered amounts of the hot melt adhesive or other thermoplastic material to downstream applicator heads, a spray-type output assembly 110 which is capable of spraying hot melt adhesive or other thermoplastic materials onto a substrate in accordance with non-contact techniques or methods, or a film coating output assembly 112 for depositing a thin film coating of the hot melt adhesive or other thermoplastic material onto a moving substrate as a result of being disposed in direct contact with the moving substrate. Therefore, it is to be noted and emphasized that in accordance with the principles and teachings of the present invention, each one of the output assemblies or devices 108,110,112 is adapted to be individually or selectively mounted upon the interface block assembly 102, in a fixed but removable manner, so as to effectively define, along with the basic assemblies comprising the interface block assembly 102, the drive gear manifold assembly 104, and the motor drive assembly 106, a different type of metering system which can be utilized to perform a different type of hot melt adhesive or other thermoplastic material dispensing function.

In addition, it is also to be noted and emphasized that in accordance with additional principles and teachings of the present invention, each one of the output devices 108, 110, 112 can be readily, easily, and quickly removed from its mounted position upon the interface block assembly 102 and effectively replaced by or exchanged with another one of the output assemblies or devices 108,110,112 so as to effectively convert a first type of metering system 100 to a second type of metering system 100 depending upon the particular type of output assembly or device 108,110,112 that is actually mounted upon the interface block assembly 102. Still yet further, if one of the output assemblies or devices 108,110, 112 experiences some type of operational failure, in lieu of shutting down the production line while the particular failed output device 108,110,112 is repaired, which is economically undesirable, the particular failed output assembly or device 108,110,112 is readily, easily, and quickly removed and replaced with a similar type of output assembly or device 108, 110,112 so as not to in fact require the production line to be shut down for an inordinate amount of time.

With reference being additionally made to FIGS. 2-8, a detailed description of the various components comprising the new and improved metering system 100 of the present invention will now be provided. As can best be appreciated from FIG. 2, for example, it is seen that the interface block assembly 102 comprises a main housing 114 upon which, for example, as will be more fully appreciated hereinafter, the drive gear manifold assembly 104 and a selected one of the output devices 108,110,112 can be mounted. A hot melt adhesive or other thermoplastic material supply interface housing 116 is fixedly secured to one end face of the main housing 114 so as to effectively serve as a means for supplying the hot melt adhesive or other thermoplastic material to the main housing 114 from a suitable supply source, such as, for example, a reservoir tank or the like, not shown, and for returning the hot melt adhesive or other thermoplastic material back to the supply source or reservoir tank, not shown, in a recirculating manner when, for example, a hot melt adhesive or other thermoplastic material dispensing or deposition operation is not actually being conducted or performed. As can be appreciated still further, with additional reference being made to FIG. 3, the hot melt adhesive or other thermoplastic material is fluidically conducted into the main housing 114 from the supply interface housing 116 by means of a horizontally oriented fluid passageway or conduit 118, and the horizontally oriented fluid passageway or conduit 118 is, in turn, fluidically connected to a pair of vertically oriented fluid passageways or conduits 120 which can also be seen in FIG. 2 and which supply the hot melt adhesive or other thermoplastic material into the drive gear manifold assembly 104.

Figure 4:
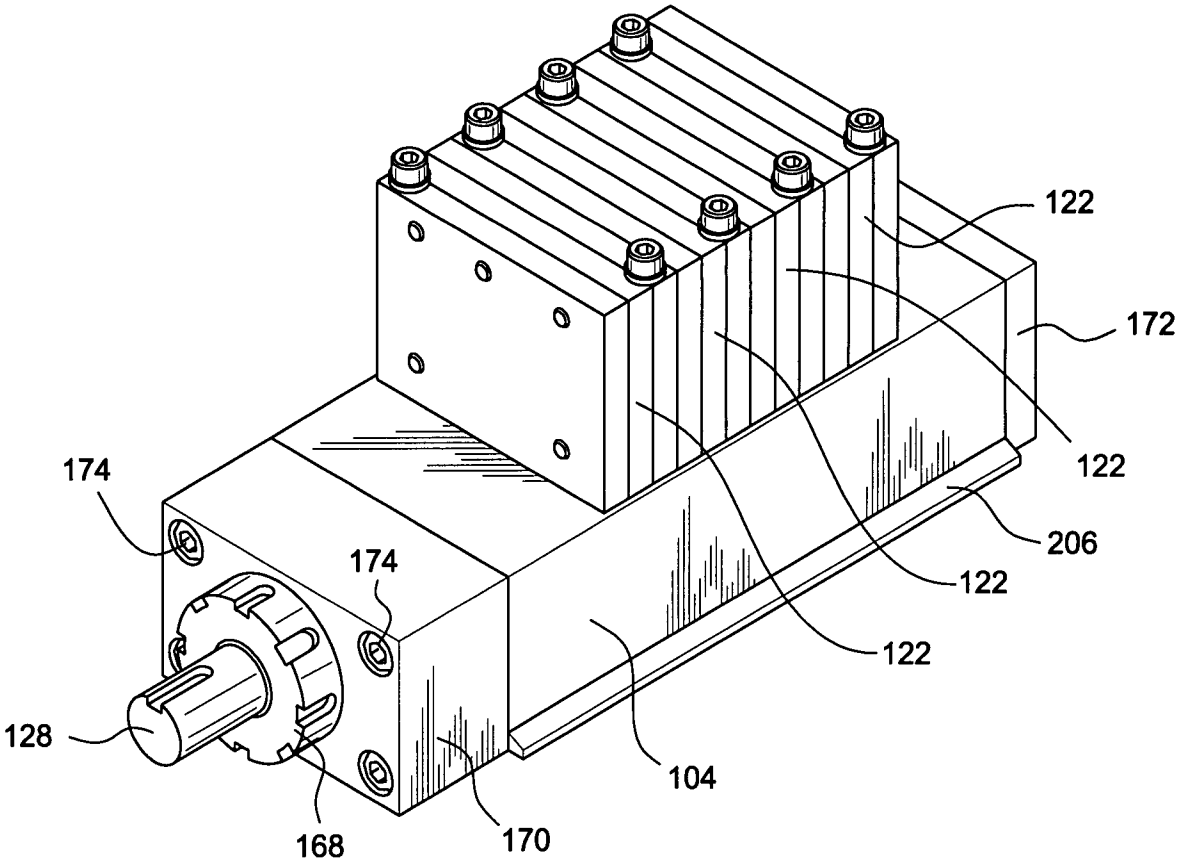
FIG. 4 is an enlarged perspective view of the drive gear manifold assembly as disclosed within FIG. 1.
Figure 5:
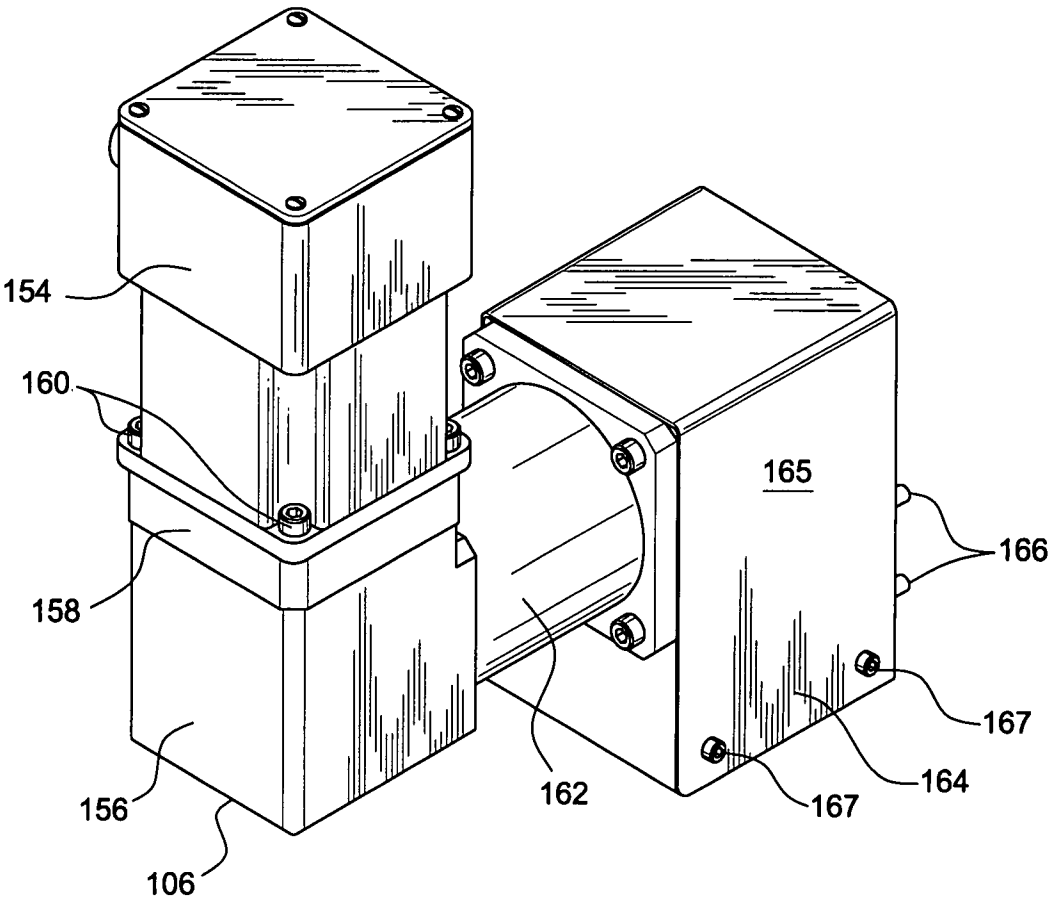
FIG. 5 is an enlarged perspective view of the motor drive assembly as disclosed within FIG. 1.

The drive gear manifold assembly 104 has a plurality of rotary, gear-type metering pump assemblies 122 fixedly mounted thereon, and as can best be seen from FIGS. 1 and 4, four rotary gear-type metering pump assemblies 122 are actually provided upon the drive gear manifold assembly 104, although the actual number of rotary, gear-type metering pump assemblies 122 can vary. In addition, it is to be noted that the removability of the drive gear manifold assembly 104, from or with respect to the interface block assembly 102 serves several purposes. Firstly, the number of pump assemblies 122 mounted upon the drive gear manifold assembly 104 can be selectively chosen. Secondly, different size pump assemblies 122 can be mounted upon the drive gear manifold assembly 104 so as to output different metered amounts of the hot melt adhesive material. Thirdly, if one of the pump assemblies malfunctions, jams, requires maintenance, repair or the like, the removability of the drive gear manifold assembly 104 from or with respect to the interface block assembly 102, as will be discussed further hereinafter, permits the entire drive gear manifold assembly 104 to be quickly removed from the interface block assembly 102 and replaced with another drive gear manifold assembly 104 in lieu of trying to initially determine which one of the pump assemblies 122 has in fact failed, jammed, or the like, and replacing that particular pump assembly 122. The vertically oriented fluid passageways or conduits 120 are, in turn, fluidically connected to a plurality of liquid supply cavities 124 which are defined within the drive gear manifold assembly 104 and which respectively annularly surround a manifold pump drive gear 126 each one of which is adapted to be operatively engaged with a pump driven gear, not shown, of a set of pump gears disposed within each one of the four rotary, gear-type metering pump assemblies 122.

Each one of the manifold pump drive gears 126 is operatively engaged upon a common drive shaft 128 through means of suitable keys, keyways, and clutch mechanisms, not shown, and as a result of such an operative drive systems, each one of the rotary, gear-type metering pump assemblies 122 is individually and separately operative so as to output a predetermined metered amount of hot melt adhesive or other thermoplastic material through means of a vertically oriented fluid passageway or conduit 130 defined within the drive gear manifold assembly 104. Each one of the vertically oriented fluid passageways or conduits 130 is, in turn, respectively fluidically connected to a vertically oriented fluid passageway or conduit 132 which are defined within the main housing 114 of the interface block assembly 102, such vertically oriented fluid passageways or conduits 132 being illustrated within both FIGS. 2 and 3, and it is further seen that each one of the vertically oriented fluid passageways or conduits 132 is respectively fluidically connected to horizontally oriented fluid passageways or conduits 134 which are also defined within the main housing 114 of the interface block assembly 102 and which respectively terminate at pump output ports 136 which are defined upon the front face or front wall member 138 of the main housing 114 of the interface block assembly 102 as viewed from the perspective of FIGS. 1 and 2. It is to be noted that while only a substantially brief description of the rotary, gear-type metering pump assemblies 122 has been set forth herein for brevity and basic understanding purposes, a more detailed description of the rotary, gear-type metering pump assemblies 122, and their deliveries or outputs of the metered amounts of hot melt adhesive or other thermoplastic materials, is described within copending U.S. patent application Ser. No. 12/083,323, which is entitled HOT MELT ADHESIVE METERING PUMP ASSEMBLY WITH INTEGRAL RESERVOIR TANK and which was filed upon Apr. 9, 2008, as well as within copending U.S. patent application Ser. No. 12/083,309, which is entitled REMOTE HOT MELT ADHESIVE METERING STATION and which was also filed upon Apr. 9, 2008, both disclosures of which are hereby incorporated herein by reference.

Figure 2:
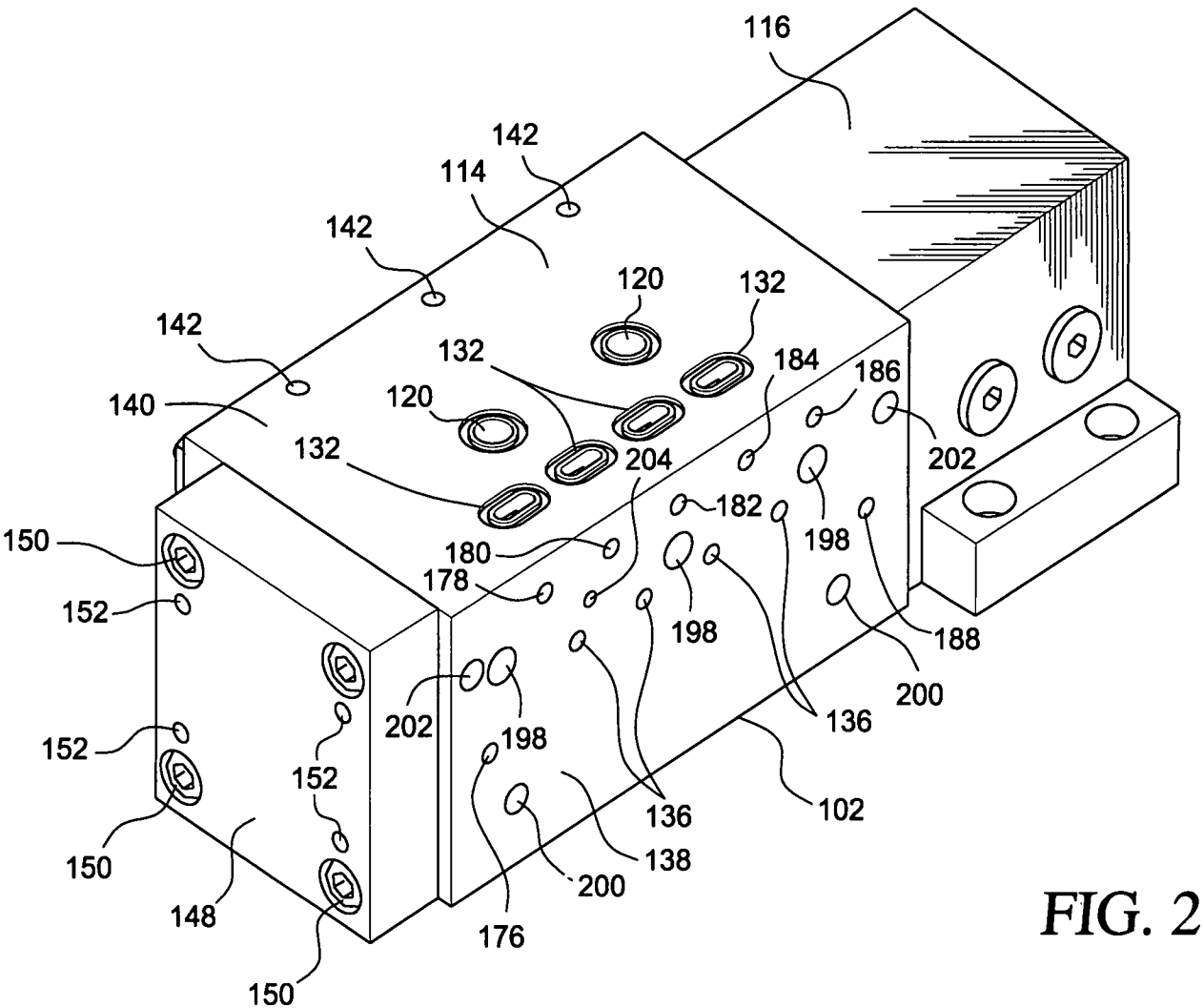
FIG. 2 is an enlarged perspective view of the interface block assembly as disclosed within FIG. 1.
Figure 3:
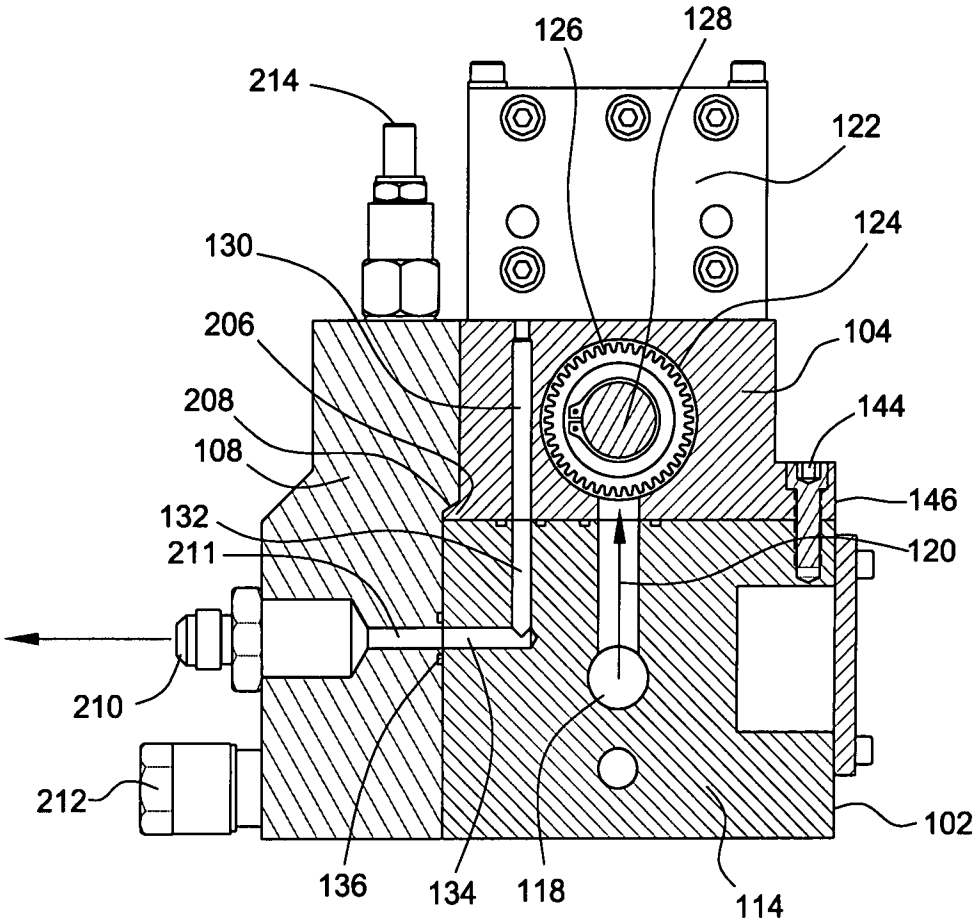
FIG. 3 is a cross-sectional view of a hot melt adhesive or other thermoplastic metering system wherein the drive gear manifold assembly and the metered output assembly or device, as disclosed within FIG. 1, have been fixedly mounted upon the interface block so as to effectively convert the hot melt adhesive or other thermoplastic metering system into the hot melt adhesive or other thermoplastic metering station.

It is further seen from FIG. 2 that the upper surface portion 140 of the main housing 114 of the interface block assembly 102 is provided with a plurality of threaded bores 142 within the vicinity of the back side or back wall member of the main housing 114, and that a plurality of bolt fasteners 144 are adapted to be threadedly engaged within such bores 142, after passing through a flanged portion 146 of the drive gear manifold assembly 104, so as to fixedly secure the drive gear manifold assembly 104 atop the main housing 114 of the interface block assembly 102 as can best be seen in FIG. 3. In addition, the interface block assembly 102 also has a mounting block or mounting plate 148 which is adapted to be fixedly secured to the left end face of the main housing 114, as viewed in FIG. 2, by means of a plurality of bolt fasteners 150, and the mounting plate 148 is, in turn, provided with a plurality of threaded bores 152 by means of which the motor drive assembly 106 can be fixedly mounted upon the interface block assembly 102. More particularly, as can best be appreciated from FIG. 5, the motor drive assembly 106 is seen to comprise a servo motor housing 154, a gear box 156 within which is disposed a right-angle gear adaptor, and a motor adaptor plate 158 by means of which the servo motor housing 154 is fixedly mounted atop the gear box 156 by means of a plurality of bolt fasteners 160.

A planetary gear reducer housing 162 is operatively connected to the gear box 156, and a drive coupling housing 164 is operatively connected to the planetary gear reducer housing 162 wherein the drive coupling disposed within the drive coupling housing 164 is adapted to be operatively connected to the drive shaft 128 of the drive gear manifold assembly 104. In addition, a plurality of bolt fasteners 166 are adapted to be threadedly inserted into through the threaded bores 152 of the mounting plate 148 of the main housing 114 so as to effectively fixedly mount the motor drive assembly 106 onto the mounting plate 148 of the interface block assembly 102. Access to the bolt fasteners 166 is provided by removing the cover member 165 of the drive coupling housing 164, which is secured upon the drive coupling housing 164 by means of bolt fasteners 167 engaged within suitable brackets, not shown, disposed internally within the drive coupling housing 164, so as to effectively gain entry to the interior of the drive coupling housing 164 and then replacing the cover member 165 once the motor drive assembly 106 has been fixedly mounted upon the interface block assembly 102. It is also seen that a suitable sealing cartridge assembly 168 annularly surrounds the drive shaft 128 of the drive gear manifold assembly 104, as best seen in FIG. 4, and that opposite end portions of the drive shaft 128 of the drive gear manifold assembly 104 are respectively disposed within suitable bearing mechanisms, not shown, disposed within a pair of end housings or end caps 170,172 which are fixedly mounted upon opposite ends of the drive gear manifold assembly 104 by means of suitable bolt fasteners 174.

Having described the basic assemblies necessary for the formulation or construction of an overall metering system 100, that is, the interface block assembly 102, the drive gear manifold assembly 104, and the motor drive assembly 106, the disclosure will now continue with a description of the various different output assemblies or devices which may be individually and selectively mounted upon, for example, the interface block assembly 102 of the overall metering system 100 so as to effectively form or construct a particular one of the various different types of metering systems 100. More particularly, for example, with reference being made to FIGS. 1-4 and 6, it is further seen that the front face or front wall member of the main housing 114 of the interface block assembly 102 is provided with a plurality of threaded apertures or bores 176,178,180,182,184,186,188 for receiving, for example, suitable bolt fasteners for respectively fixedly, but removably, mounting a particular one of the output assemblies or devices 108,110,112 upon the interface block assembly 102. It is noted that each one of the output assemblies or devices 108,110,112 may have different locations defined therein for accommodating the bolt fasteners, and thus, in order for the main housing 114 of the interface block assembly 102 to effectively accommodate the various different types of output assemblies or devices in a universal or interchangeable manner, the main housing 114 of the interface block assembly 102 needs to be provided with the necessary apertures or bores 176-188 even though, in order to mount a particular one of the output assemblies or devices 108,110, 112, one or more of the apertures or bores 176 through 188 will not actually have a bolt fastener disposed therein. For example, as is illustrated within FIG. 6, the output assembly or device 108 is provided with four bores in which four bolt fasteners 190,192,194,196 are respectively disposed. Accordingly, as can be appreciated from the pattern of such bores and the bolt fasteners 190-196 disposed within the output assembly or device 108, when the output assembly or device 108 is to be mounted upon the interface block assembly 102, the bolt fasteners 190-196 will be respectively engaged within the threaded bores 176,180,184, and 188 of the front face or front wall member 138 of the main housing 114 of the interface block assembly 102.

The main housing 114 of the interface block assembly 102 is further provided with a plurality of laterally spaced bores 198 for accommodating heater cartridges, not shown, by means of which heat is supplied to the main housing 114 so as to maintain the temperature of the hot melt adhesive or other thermoplastic material at a predetermined temperature level, as well as a pair of laterally spaced hot melt adhesive or other thermoplastic material return or recirculation bores 200 for returning unused hot melt adhesive or other thermoplastic material back to the supply source or reservoir tank, not shown, which is operatively connected to the hot melt adhesive or other thermoplastic material supply interface housing 116 of the interface block assembly 102. Still yet further, the front face or front wall member 138 of the main housing 114 is also provided with a pair of laterally spaced bores 202 within which a pair of dowel pins, not shown, disposed upon, for example, the rear surface of the output assembly or device 108, can be accommodated so as to facilitate the proper location and disposition of the output assembly or device 108 upon the interface block assembly 102 prior to the fixation thereof by means of the bolt fasteners 190-196. Lastly, the front face or front wall member 138 of the main housing 114 is provided with a bore 204 for housing a temperature sensor, not shown, in order to sense the temperature level within the main housing 114 of the interface block in order to maintain the desired temperature set point of the hot melt adhesive or other thermoplastic material. The temperature sensor, not shown, is operatively connected to the heater cartridges, not shown, disposed within the bores 198 so as to energize or de-energize the same in order to maintain the temperature set point as necessary.

Figure 6:
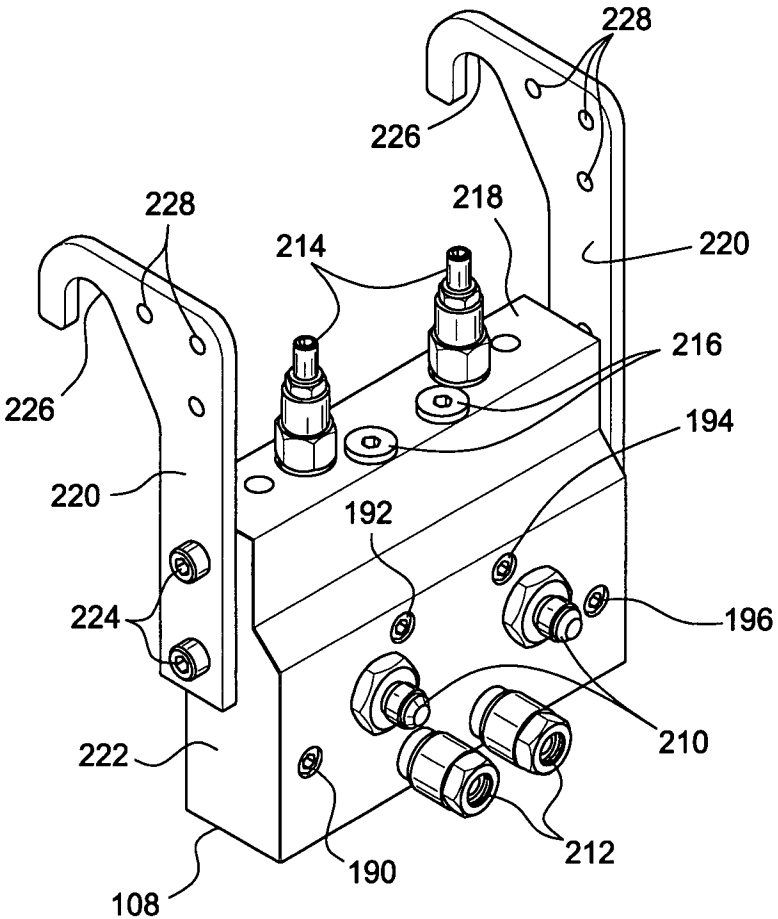
FIG. 6 is an enlarged perspective view of the metered output assembly, as disclosed within FIG. 1, which when mounted upon the interface block assembly effectively converts the hot melt adhesive or other thermoplastic metering system into a hot melt adhesive or other thermoplastic material metering station.

As can best be appreciated from FIGS. 3,4, and 6, it is seen that the drive gear manifold assembly 104 is provided with a longitudinally extending ledge or foot portion 206, and that the back side or back wall member of the metered output assembly or device 108 effectively has a stepped configuration so as to define an angled shoulder portion 208 which is adapted to be engaged with and seated upon the ledge or foot portion 206 of the drive gear manifold assembly 104. In this manner, the metered output assembly or device 108 is able to be precisely positioned upon, or with respect to, the drive gear manifold assembly 104 and in turn with respect to the interface block assembly 102, as may best be appreciated from FIG. 3. It is to be noted that once the metered output assembly or device 108 is fixedly mounted upon the interface block assembly 102, and it is desired to remove and replace the drive gear mani-fold assembly 104, all that needs to be done is to remove the bolt fasteners 144 fixedly securing the drive gear manifold assembly 104 to the interface block assembly 102 and the drive gear manifold assembly 104 can be removed from the interface block assembly 102 simply by sliding the drive gear manifold assembly 104 in its axial direction away from the interface block assembly 102 as facilitated by the ledge or foot portion 206 of the drive gear manifold assembly 104 sliding beneath the shoulder portion 208 of the metered output assembly or device 108.

Continuing further, it is seen that the metered output assembly or device 108 is provided with a pair of hot melt adhesive or other thermoplastic material output hose connectors 210 which are fluidically connected at their upstream end portions to the hot melt adhesive or other thermoplastic material pump output ports 136, defined within the front face or front wall member 138 of the main housing section 114 of the interface block assembly 102, by means of fluid passageways or conduits 211 defined within the metered output assembly or device 108 as can best be seen in FIG. 3, so as to, for example, provide connections to hose members, not shown, to be fluidically connected to suitable hot melt adhesive or other thermoplastic material applicator heads, not shown. In this manner, the metered output assembly or device 108, together with the interface block assembly, the drive gear manifold assembly 104, and the motor drive assembly 106, effectively form a hot melt adhesive or other thermoplastic material metering station. While only two output hose connections 210 are disclosed, wherein each one of the output hose connections 210 is connected to two of pump output ports 136 so as to output predetermined volumes of the hot melt adhesive or other thermoplastic material to the downstream applicator heads, not shown, the number of output hose connections 210 may vary depending upon, for example, the predetermined volume of hot melt adhesive or other thermoplastic material is desired to be conducted to each one of the downstream applicator heads, not shown.

The metered output assembly or device 108 is further provided with a pair of bleed valve structures 212 which are actuated so as to permit the fluid hoses to be safely removed from the output hose connections 210 when so desired, and a pair of pressure relief valves 214, as well as a pair of pressure transducer ports 216, are also disposed upon an upper surface portion 218 of the metered output assembly or device 108. Lastly, it is seen that the metered output assembly or device 108 has a pair of upstanding bracket members 220 fixedly secured to side wall portions 222 of the metered output assembly or device 108 by means of suitable bolt fasteners 224. Such bracket members 220 serve dual purposes, firstly as a means for enabling the metered output assembly or device 108 to be carried and transported as a result of, for example, suitable apparatus engaging the hooked portions 226 of the bracket members 220, and in addition, the bracket members 220 also have a plurality of apertures 228 defined therein for enabling the metered output assembly or device 108 to be fixedly mounted upon a framework member, not shown, of the overall production line apparatus or system, by means of suitable fasteners, not shown.

Figure 7:
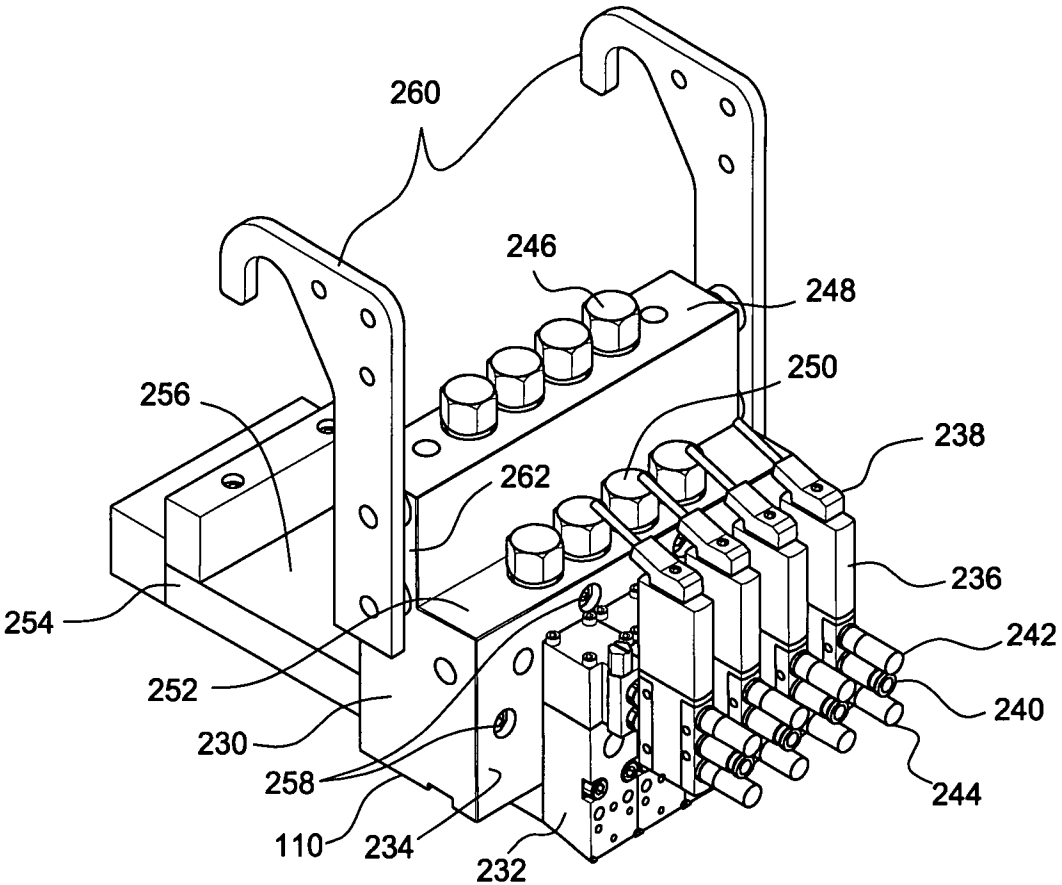
FIG. 7 is an enlarged perspective view of the hot melt adhesive or other thermoplastic material spray output assembly or device as disclosed within FIG. 1.

With reference now being made to FIG. 7, the hot melt adhesive or other thermoplastic material spray output assembly or device 110, as disclosed within FIG. 1, will now be described. More particularly, it is seen that the hot melt adhesive or other thermoplastic material spray output assembly or device 110 comprises a main body section 230, having a stepped configuration, wherein a plurality, such as, for example, four, of hot melt adhesive or other thermoplastic, valve-controlled switching modules 232 are fixedly mounted upon the front face or front wall member 234 of the main body section 230 so as to dispense the hot melt adhesive or other thermoplastic material from the hot melt adhesive or other thermoplastic material spray output assembly or device 110 in a predetermined spray pattern. A plurality of solenoid controlled valve assemblies 236 are respectively operatively connected to each one of the switching modules 232, and suitable electrical connectors 238 are operatively connected to the solenoid-controlled valve assemblies 236 so as to provide electrical power thereto. In addition, each one of the solenoid-controlled valve assemblies 236 is provided with a control air input conduit 240, and a pair of exhaust or control air output conduits 242,244 wherein the control air is utilized in conjunction with the valve-controlled switching modules 232 so as to open and close the dispensing valve mechanisms disposed within each one of the valve-controlled switching modules 232. A plurality of high-pressure relief valves 246 are disposed upon an upper surface portion 248 of the main body section 230, and a plurality of low-pressure relief valves 250 are disposed upon an intermediate ledge portion 252 of the main body section 230, wherein both sets of relief valves 246,250 are operatively connected to hot melt adhesive or other thermoplastic material recirculation ports and passageways provided between the source of the hot melt adhesive or other thermoplastic material and the plurality of switching modules 232.

The main body section 230 is also seen to be fixedly disposed upon an air pre-heater housing 254, which is provided for pre-heating the incoming air to be used in conjunction with the spraying of the hot melt adhesive or other thermoplastic material out from the dispensing valve mechanisms of the switching modules 232, and it is seen that the air preheater housing 254 is provided with an upper surface portion 256 upon which the main housing 114 of the interface block assembly 102 is adapted to be seated. The main body section 230 is adapted to be fixedly secured to the main housing 114 of the interface block assembly 102 by means of a plurality of bolt fasteners 258 which will threadedly engage the threaded apertures or bores 176,180,184,188 defined within the front face or front wall member 138 of the main housing 114 of the interface block assembly 102 in a manner similar to the fixation of the metered output assembly 108 onto the front face or front wall member 138 of the main housing 114 of the interface block assembly 102, by means of the bolt fasteners 190-196, as illustrated within FIG. 6. It is also noted, in a manner also similar to the structure comprising the metered output assembly 108, that the hot melt adhesive or other thermoplastic material spray output assembly or device 110 further comprises a pair of bracket members 260 that are fixedly secured to oppositely disposed side wall members 262 of the main body section 230 by means of suitable bolt fasteners, not shown.

Figure 8:
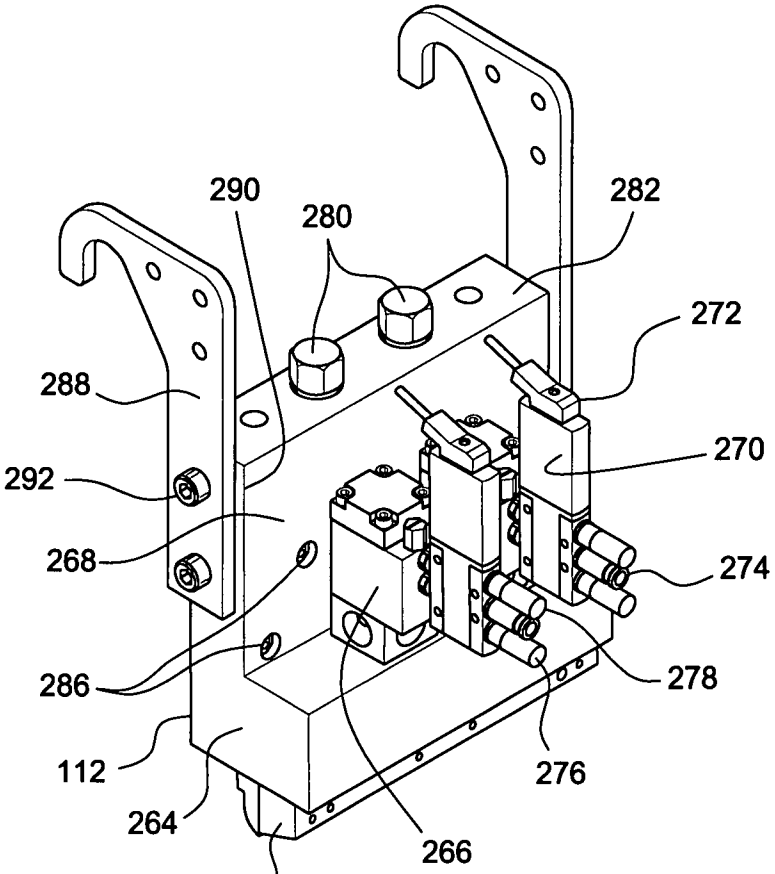
FIG. 8 is an enlarged perspective view of the hot melt adhesive or other thermoplastic material film coating output assembly or device as disclosed within FIG. 1.

With reference lastly being made to FIG. 8, the hot melt adhesive or other thermoplastic material film coating output assembly or device 112, as disclosed within FIG. 1, will now be described. More particularly, it is seen that the hot melt adhesive or other thermoplastic material film coating output assembly or device 112 comprises a main body section 264, having a substantially L-shaped cross-sectional configuration, and that a plurality, such as, for example, two, of hot melt adhesive or other thermoplastic, valve-controlled switching modules 266 are fixedly mounted upon the front face or front wall member 268 of the main body section 264 so as to dispense the hot melt adhesive or other thermoplastic material from the hot melt adhesive or other thermoplastic material film coating output assembly or device 112 in a predetermined film coating pattern. A plurality of solenoid controlled valve assemblies 270 are respectively operatively connected to each one of the switching modules 266, and suitable electrical connectors 272 are operatively connected to the solenoid-controlled valve assemblies 270 so as to provide electrical power thereto. In addition, each one of the solenoid-controlled valve assemblies 270 is provided with a control air input conduit 274, and a pair of exhaust or control air output conduits 276,278 wherein the control air is utilized in conjunction with the valve-controlled switching modules 266 so as to open and close the dispensing valve mechanisms disposed within each one of the valve-controlled switching modules 266.

A plurality of high-pressure relief valves 280 are disposed upon an upper surface portion 282 of the main body section 264, wherein the relief valves 280 are operatively connected to hot melt adhesive or other thermoplastic material recirculation ports and passageways provided between the source of the hot melt adhesive or other thermoplastic material and the plurality of switching modules 266. A slot die film coating applicator 284 is fixedly mounted upon an undersurface portion of the main body section 264 so as to deposit a coating or film of the hot melt adhesive or other thermoplastic material onto a moving substrate in accordance with contact techniques or methods, and while the details of such slot die film coating applicator 284 are not disclosed herein, in view of the fact that such details do not form a part of the present invention, a more detailed description of such a slot die film coating applicator 284 may be derived from copending U.S. patent application Ser. No. 12/073,374, which is entitled DUAL PATTERN SHIM ASSEMBLY FOR USE IN CONJUNCTION WITH HOT MELT ADHESIVE DISPENSING SYSTEMS, and which was filed on Mar. 5, 2008, the disclosure of which is hereby incorporated herein by reference. The main body section 264 is adapted to be fixedly secured to the main housing 114 of the interface block assembly 102 by means of a plurality of bolt fasteners 286 which will threadedly engage the threaded apertures or bores 176,178,182,186,188 defined within the front face or front wall member 138 of the main housing 114 of the interface block assembly 102 in manners similar to the fixation of the metered output assembly 108 and the spray output assembly 110 onto the front face or front wall member 138 of the main housing 114 of the interface block assembly 102, by means of the bolt fasteners 190-196,258 as illustrated within FIGS. 6 and 7. It is to be noted that when the film coating output assembly or device 112 is actually mounted upon the front face or front wall member 138 of the main housing 114 of the inter-face block assembly 102, the elevational disposition of the slot die film coating applicator 284 will be disposed at a relatively low elevational level so as to in fact permit the slot die film coating applicator 284 to be disposed in con-tact with the underlying substrate. It is also noted, in a manner also similar to the structure comprising the metered output assembly 108 and the spray output assembly 110, that the hot melt adhesive or other thermoplastic material film coating output assembly or device 112 further comprises a pair of bracket members 288 that are fixedly secured to oppositely disposed side wall members 290 of the main body section 264 by means of suitable bolt fasteners, 292.

Thus, it may be seen that in accordance with the principles and teachings of the present invention, there has been provided a new and improved hot melt adhesive or other thermoplastic material metering system which comprises multiple different modular components, assemblies, or devices. For example, each metering system will comprise modularized basic components, comprising, for example, an interface block assembly to which hot melt adhesive or other thermoplastic material is inputted into and outputted out from, a motor drive assembly, and a drive gear manifold assembly. In addition, any one of several different output assemblies or devices are also adapted to be individually and selectively mounted upon the interface block assembly in a modularized and exchangeable or interchangeable manner. Accordingly, if it is desired to effectively convert a particular metering system, characterized by means of a first type of output assembly or device, to another type of metering system, characterized by means of a second type of output assembly or device, the first output assembly or device can be readily, easily, and quickly removed from the interface block, and the second output assembly or device can be readily, easily, and quickly installed upon the interface block. In addition, if a particular type of output assembly or devices needs to be replaced or repaired, the particular output assembly or device can be readily, easily, and quickly removed from the interface block and a new similar output assembly or device can be readily, easily, and quickly installed upon the interface block without incurring any downtime or loss in production. It is also noted that in accordance with the principles and teachings of the present invention, the metering system 100 can effectively be converted from a left-side drive system to a right-side drive system as may be required or desired.

For example, as is disclosed within FIG. 1, the metering system 100 comprises a left side drive system in that, for example, the motor drive assembly 106 is mounted upon the left mounting plate 148 of the interface block assembly 102 as can be seen in FIG. 2, and the drive shaft 128 of the drive gear manifold assembly 104 projects outwardly from the left end portion thereof so as to be operatively connected to the output drive coupling-disposed within the drive coupling housing 164. However, if it is desired to effectively convert the left-side drive system to a right-side drive system, then such a drive conversion can effectively be accomplished as a result of removing the hot melt adhesive or other thermoplastic material supply interface housing 116 from the right side of the interface block assembly 102, removing the left mounting plate 148 of the interface block assembly 102 from the left side of the interface block assembly 102, and re-mounting such components on the opposite sides of the interface block assembly 102. In this manner, the motor drive assembly 106 will now be mounted upon the right side of the interface block assembly 102. Correspondingly, the end housings or end caps 170,172 are removed from their respective ends of the drive gear manifold assembly 104 and remounted upon the opposite ends of the drive gear manifold assembly 104 so as to permit the drive shaft 128 of the drive gear manifold assembly 104 to again be operatively connected to the output drive coupling disposed within the drive coupling housing 164.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A fluid output metering system for selectively outputting different types of fluid output patterns from different types of fluid output assemblies, comprising:

an interface block assembly for receiving a supply of fluid to be outputted to a fluid output assembly;

a drive gear manifold assembly mounted upon said interface block assembly;

at least one metering pump assembly mounted upon said interface block for receiving fluid from said interface block assembly and for outputting a metered amount of fluid back to said interface block assembly;

a motor drive assembly operatively connected to said drive gear manifold assembly so as to drive said at least one metering pump assembly; and a plurality of different types of fluid output assemblies which are individually and selectively capable of being mounted in an interchangeable manner upon said interface block assembly so as to receive metered output amounts of fluid from said interface block assembly and thereby respectively define different types of fluid output metering systems, together with said interface block assembly, said drive gear manifold assembly having said at least one metering pump assembly mounted thereon, and said motor drive assembly, as a function of which particular one of said plurality of different types of fluid output assemblies is mounted, at a particular point in time, upon said interface block assembly, from which different types of fluid outputs can be generated, whereby as a result of the selection of one of said plurality of different types of fluid output assemblies being mounted in said interchangeable manner upon said interface block assembly, a single interface block assembly, along with its drive gear manifold assembly, its metering pump assembly, and its motor drive assembly, can be utilized with multiple different types of fluid output assemblies to output any one of a plurality of different types of fluid outputs.

2. The fluid output metering system as set forth in claim 1, wherein:

said plurality of different types of fluid output assemblies comprise modular components which can be readily, easily, and quickly mounted upon, and removed from, said interface block assembly so as to readily, easily, and quickly convert a first type of fluid output metering system, having a first type of fluid output assembly mounted thereon, to a second different type of fluid output metering system, having a second type of fluid output assembly mounted thereon, by exchanging a second type of fluid output assembly for said first type of fluid output assembly mounted upon said interface block assembly.

3. The fluid output metering system as set forth in claim 2, wherein:

said interface block assembly has structure defined thereon for individually accommodating a selected one of said plurality of different types of fluid output assemblies thereon so as to define said particular type of fluid output metering system.

4. The fluid output metering system as set forth in claim 3, further comprising:

fasteners for fixedly yet removably mounting a selected one of said plurality of different types of fluid output assemblies upon said interface block assembly; and said structure defined upon said interface block assembly for individually accommodating selected ones of said plurality of different types of fluid output assemblies comprises a plurality of bores arranged within a predetermined pattern upon said interface block assembly for receiving said fasteners, whereby, regardless of the particular location and number of fasteners required to fixedly yet removably mount a selected one of said plurality of different types of fluid output assemblies upon said interface block assembly, each one of said plurality of different types of fluid output assemblies can be accommodated by said interface block assembly so as to in fact fixedly yet removably mount a selected one of said plurality of different types of fluid output assemblies upon said interface block assembly.

5. The fluid output metering system as set forth in claim 1, wherein:

one of said plurality of different types of fluid output assemblies comprises a metered output assembly having fluid output hose connections provided thereon for conducting said metered amounts of fluid to downstream applicator heads.

6. The fluid output metering system as set forth in claim 1, wherein:

one of said plurality of different types of fluid output assemblies comprises a plurality of modules for spraying metered amounts of the fluid onto a substrate.

7. The fluid output metering system as set forth in claim 1, wherein:

one of said plurality of different types of fluid output assemblies comprises a plurality of modules and slot die means for dispensing said metered amounts of fluid onto a substrate in the form of a film.

8. The fluid output metering system as set forth in claim 1, wherein:

said plurality of different types of fluid output assemblies comprise modular components which can be readily, easily, and quickly mounted upon, and removed from, said interface block assembly so as to readily, easily, and quickly replace a first fluid output assembly, mounted upon said interface block assembly and thereby defining a first type of output metering system, with an identical second fluid output assembly so as to likewise define said first type of output metering system, by removing said first fluid output assembly from said interface block assembly and mounting said identical second fluid output assembly upon said interface block assembly.

9. The fluid output metering system as set forth in claim 1, wherein:

said fluid output metering system can be converted between left side and right side drive systems.

10. The fluid output metering system as set forth in claim 9, wherein:

said drive gear manifold assembly comprises a drive shaft projecting outwardly from one side thereof so as to be drivingly connected to said motor drive assembly; and structure is defined upon said interface block assembly and said drive gear manifold assembly so as to permit said motor drive assembly to be mounted upon either side of said interface block assembly and to permit said drive shaft of said drive gear manifold assembly to project outwardly from either side of said drive gear manifold assembly so as to be drivingly connected to said motor drive assembly.

11. The fluid output metering system as set forth in claim 1, wherein:

said plurality of different types of fluid output assemblies which are individually and selectively capable of being mounted in an interchangeable manner upon said interface block assembly so as to receive metered output amounts of fluid from said interface block assembly and thereby respectively define different types of fluid output metering systems, together with said interface block assembly, said drive gear manifold assembly having said at least one metering pump assembly mounted thereon, and said motor drive assembly, as a function of which particular one of said plurality of different types of fluid output assemblies is mounted upon said interface block assembly, are selected from the group comprising a metered output assembly, a spray-type output assembly, and a film coating output assembly.

* * * * *